US007915532B2

(12) United States Patent
Varkey et al.

(10) Patent No.: US 7,915,532 B2
(45) Date of Patent: Mar. 29, 2011

(54) ENHANCED ELECTRICAL SEISMIC LAND CABLE

(75) Inventors: Joseph Varkey, Sugar Land, TX (US); Byong Un Kim, Sugar Land, TX (US); Jushik Yun, Sugar Land, TX (US); Willem A. Wijnberg, Houston, TX (US); Montie W. Morrison, Sugar Land, TX (US)

(73) Assignee: WesternGeco L.L.C., Houston, TX (US)

( * ) Notice: Subject to any disclaimer, the term of this patent is extended or adjusted under 35 U.S.C. 154(b) by 364 days.

(21) Appl. No.: 12/135,015

(22) Filed: Jun. 6, 2008

(65) Prior Publication Data

US 2008/0302556 A1 Dec. 11, 2008

Related U.S. Application Data

(60) Provisional application No. 60/933,932, filed on Jun. 8, 2007.

(51) Int. Cl.
*H01B 7/00* (2006.01)

(52) U.S. Cl. ..... 174/110 R; 174/113 R; 174/113 C

(58) Field of Classification Search ..... 174/102 R, 174/103, 106, 105 R, 108, 110 R, 113 R, 174/120 R, 121 R; 385/100–101, 106–107, 385/109, 111

See application file for complete search history.

(56) References Cited

U.S. PATENT DOCUMENTS

| | | | | |
|---|---|---|---|---|
| 3,602,632 | A * | 8/1971 | Ollis | 174/36 |
| 3,784,732 | A * | 1/1974 | Whitfill, Jr. | 174/108 |
| 4,440,974 | A * | 4/1984 | Naudet | 174/108 |
| 4,538,022 | A * | 8/1985 | Barnicol-Ottler et al. | 174/113 R |
| 4,563,757 | A | 1/1986 | Decorps | |
| 4,575,831 | A | 3/1986 | Decorps | |
| 4,675,475 | A * | 6/1987 | Bortner et al. | 174/113 R |
| 5,082,995 | A * | 1/1992 | Paterson et al. | 174/113 R |
| 5,389,736 | A * | 2/1995 | Ziemek et al. | 174/36 |
| 5,777,273 | A * | 7/1998 | Woody et al. | 174/113 R |
| 6,260,656 | B1 | 7/2001 | Orban | |
| 6,359,230 | B1 | 3/2002 | Hildreth | |
| 6,600,108 | B1 * | 7/2003 | Mydur et al. | 174/120 R |
| 7,005,583 | B2 * | 2/2006 | Varkey et al. | 174/120 R |
| 7,009,113 | B2 * | 3/2006 | Varkey | 174/102 R |
| 7,235,743 | B2 | 6/2007 | Varkey | |
| 7,288,721 | B2 * | 10/2007 | Varkey et al. | 174/102 R |

FOREIGN PATENT DOCUMENTS

| | | |
|---|---|---|
| EP | 0222507 A1 | 10/1986 |
| EP | 0947868 A2 | 3/1999 |
| EP | 1398797 A1 | 8/2003 |

OTHER PUBLICATIONS

PCT Search Report, dated Sep. 25, 2008, for Application No. PCT/US2008/066323 filed Sep. 25, 2008.

* cited by examiner

*Primary Examiner* — William H Mayo, III

(57) ABSTRACT

An electrical cable having a polymeric inner layer enclosing a cable core, and a polymeric outer layer enclosing the cable core and the inner layer. The outer layer operable to maintain integrity of the cable within a predetermined temperature range.

19 Claims, 5 Drawing Sheets

ENHANCED ELECTRICAL SEISMIC LAND CABLE

CROSS-REFERENCE TO RELATED APPLICATION

This application is entitled to the benefit of, and claims priority to, provisional patent application U.S. 60/933,932 filed Jun. 8, 2007, the entire disclosure of which is incorporated herein by reference.

BACKGROUND OF THE INVENTION

The present invention relates generally to cables and, in particular, to an enhanced electrical cable.

SUMMARY OF THE INVENTION

An embodiment of a cable comprises a cable core comprising at least one electrical conductor, at least one polymeric inner layer enclosing the cable core; and at least one polymeric outer layer enclosing the cable core and the inner layer to form the electrical cable, the outer layer operable to maintain integrity of the cable within a predetermined temperature range. Alternatively, the predetermined temperature range is from about −60° Celsius to about 80° Celsius. Alternatively, the outer layer comprises one of polyamide, thermoplastic polyurethane, thermoplastic vulcanizate, a hard grade thermoplastic elastomer, ethylene chlorotrifluoroethylene, ethylene-tetrafluoroethylene copolymer, and combinations thereof. Alternatively, the inner layer comprises one of polyolefin, fluoropolymer, thermoplastic elastomer, thermoplastic vulcanizate and combinations thereof. Alternatively, the electrical conductor comprises a plurality of conductors helically wound about a central electrical conductor. Alternatively, the electrical cable further comprises at least one shield layer disposed adjacent at least one of the cable core, the inner layer, and the outer layer. The shield layer may comprise one of interlocking metallic tape and metallic mesh tape.

Alternatively, the cable further comprises an intermediate tie layer disposed between the inner layer and the outer layer and operable to bind with both the inner layer and the outer layer. The intermediate tie layer may comprise one of modified polyethylene, modified fluoropolymer, modified polypropylene, modified ethylene-propylene copolymer, modified poly(4-methyl-1-pentene), modified thermoplastic vulcanizate, modified thermoplastic elastomer, modified ethylene-tetrafluoroethylene copolymer, modified ethylene fluorinated ethylene-propylene, modified polychlorotrifluoroethylene, modified ethylene chlorotrifluoroethylene, expanded-Polytetrafluoroethylene (ePTFE) and combinations thereof.

In another embodiment, an electrical cable assembly comprises a cable core comprising at least one filler rod, a plurality of conductors arranged about the filler rod to form the cable core, the conductors having internal interstices therebetween filled by the filler rod, each of the conductors comprising a conductor core comprising at least one electrical conductor, at least one polymeric inner layer enclosing the conductor core, and at least one polymeric outer layer enclosing the conductor core and the inner layer to form the conductor, the outer layer operable to maintain integrity of the conductor within a predetermined temperature range, wherein the cable core is enclosed by a filler layer of elastomeric material that fills external interstices between the conductors to form the cable assembly.

Alternatively, the conductors forming the cable core comprise one of a triad configuration, a quad configuration, and a hepta configuration. Alternatively, the cable assembly further comprises a jacket layer enclosing the filler layer and the cable core. A plurality of strength members may be embedded in the jacket layer. Alternatively, the cable assembly further comprises at least one layer of strength members disposed within the outer layer. At least one of the strength members may be formed from Kevlar material and may be oriented at a zero lay angle with respect to the cable core. Alternatively, the cable assembly further comprises at least one shield layer enclosing the filler layer. Alternatively, the filler rod is formed from one of a soft polymeric material, a hard TPE coated rod, and a hard TPE coated rod yarn.

In another embodiment, a method for forming a cable comprises providing at least one filler rod, cabling a plurality of conductors about the filler rod to form a cable core, the filler rod filling internal interstices between the conductors, wherein each of the conductors comprise a conductor core comprising at least one electrical conductor, at least one polymeric inner layer enclosing the conductor core, and at least one polymeric outer layer enclosing the conductor core and the inner layer to form the conductor, the outer layer operable to maintain integrity of the conductor within a predetermined temperature range, and enclosing the cable core with a filler layer of elastomeric material that fills external interstices between the conductors to form the cable.

Alternatively, the method further comprises enclosing the cable core and filler layer in a jacket layer. Alternatively, the method further comprises disposing at least one strength member in the jacket layer. Alternatively, the method further comprises heating the filler rod to assist in cabling the conductors about the filler rod. Alternatively, the filler rod and the filler layer are extruded. Alternatively, the method further comprises disposing at least one shield layer adjacent at least one of the cable core, the inner layer, and the outer layer.

Embodiments of cables and cable assemblies may be advantageously utilized as land seismic cables and/or may be utilized alone or in combination to create land seismic cables with some or all of the following characteristics lower cost, easy manufacturing, water blocking capabilities, the ability to perform well at arctic and tropical temperatures, and minimize damage from animal biting. The potential for bonding between all materials in the cable core significantly increases the cable's resistance to water infiltration. The conductor insulation's three-layered bonded design is also easily potted to various potting compounds

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
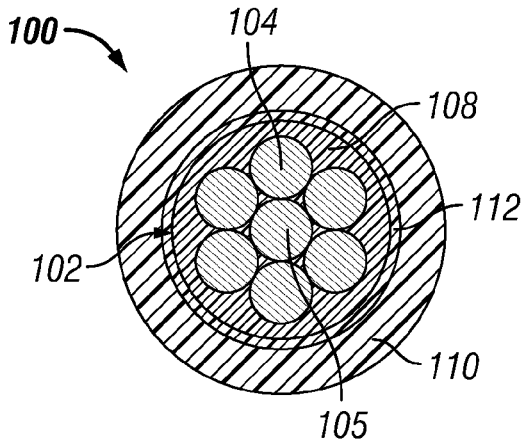
FIG. 1 is a radial cross-sectional view of an embodiment of a cable.

Referring now to FIG. 1, there is shown an embodiment of a cable, indicated generally at 100. The cable 100 includes a cable core 102 comprising a plurality of electrical conductors 104 (only one indicated). The electrical conductors 104 preferably comprise a plurality of conductors cabled helically around a central conductor 105. Preferably, the electrical conductors 104 are formed from a copper material or similarly electrically conductive material.

An inner layer 108 formed from a polymer material, for example, encases the electrical conductors 104 of the cable core 102. An outer layer 110 formed from a polymer material, for example, encases the inner layer 108 and an optional tie layer 112 is disposed between the inner layer 108 and the outer layer 110.

The inner layer 108 may comprise a polyolefin (such as polyethylene (PE), ethylene-propylene copolymer (EPC), Poly(4-methyl-1-pentene) (TPX), or another suitable polyolefin) that provides good electrical insulation properties. The inner layer 108 may comprise a fluoropolymer (such as ETFE [Tefzel®] or ECTFE [Halar®]). The inner layer 108 may also comprise a thermoplastic elastomer (TPE) or thermoplastic vulcanizate (TPV), such as, but not limited to, Santoprene™, Engage™, Elexar™ or Infuse™.

The outer layer 110 may comprise polyamide (Nylon) or thermoplastic polyurethane (TPU) or other suitable polymer. The outer layer 110 may comprise a hard grade thermoplastic elastomer (TPE) or thermoplastic vulcanizate (TPV), such as, but not limited to, Santoprene™ Engage™, Elexar™ or Infuse™. The outer layer 110 may comprise ethylene chlorotrifluoroethylene (ECTFE) such as Halar™, ethylene-tetrafluoroethylene copolymer (ETFE) such as Tefzel™, or any other suitable TPE, TPV or thermoset rubber. The outer layer 110 preferably comprises a material that is durable, flexible, can bond to the tie layer 112 (discussed in more detail below), can bond to TPE interstitial filler materials, TPV interstitial filler materials or potting materials, and perform well by maintaining its material properties and thus the integrity of the cable in temperatures ranging from about −60° Celsius to about 150° Celsius or from about −60° Celsius to about 80° Celsius or from about −20° Celsius to about 80° Celsius, thereby allowing electrical power to be transmitted through the cable 100.

The tie layer 112 may comprise the same polymer used in the inner layer 108 modified with maleic anhydride, acrylic acid, or another suitable material. The tie layer 112 facilitates bonding of the inner layer(s) 108 and the outer layer 110, thereby creating a continuous bonded insulation system for the cable 100. The tie layer 112, may comprise polyethylene (PE) modified with a suitable functional chemical group such as maleic anhydride, acrylic acid, etc., (Bynel® by Dupont, Polybond® by Crompton Corporation etc.). The tie layer 112 may comprise polypropylene (PP) modified with a suitable functional chemical group such as maleic anhydride, acrylic acid, etc., (ADMER® by Mitsui Chemicals, Polybond® by Crompton Corporation etc.). The tie layer 112 may comprise ethylene-propylene copolymer (EPC) modified with a suitable functional chemical group such as maleic anhydride, acrylic acid, etc., (ADMER® by Mitsui Chemicals etc.). The tie layer 112 may comprise poly(4-methyl-1-pentene) (TPX) modified with a suitable functional chemical group maleic anhydride, acrylic acid, etc. (ADMER® by Mitsui Chemicals). The tie layer 112 may comprise maleic-anhydride modified or acrylic-modified TPV (such as Santoprene™) or any other TPE.

The tie layer 112 may comprise ethylene-tetrafluoroethylene copolymer (ETFE) modified with a suitable functional chemical group maleic anhydride, acrylic acid, etc. (Tefzel® HT 2202 by Dupont, NEOFLON™ ETFE EP-7000 by Daikin), ethylene fluorinated ethylene-propylene (EFEP) terpolymers (NEOFLON™ EFEP by Daikin), polychlorotrifluoroethylene (PCTFE) modified with a suitable functional chemical group (such as, but not limited to, maleic anhydride, acrylic acid), ethylene chlorotrifluoroethylene (ECTFE) modified with a suitable functional chemical group (such as, but not limited to, maleic anhydride, acrylic acid), expanded-Polytetrafluoroethylene (ePTFE) adhered to the inner insulating layer(s) 108, 308, 408, 608, 808, 1008, or 1214 (specially manufactured process such as high temperature heat-applied sintering and taping), or any type of modified fluoropolymer that can adhere to the inner layer 108 or the outer layer 110. Preferably the tie layer 112 bonds to each of the inner layer 108 and the outer layer 110.

The electrical conductors 104 are preferably in communication with, for example, a source of electrical power (not shown) and an electrical tool or device (not shown) and are operable to transmit electrical power between the electrical power source and the electrical tool or device.

Figure 2B:
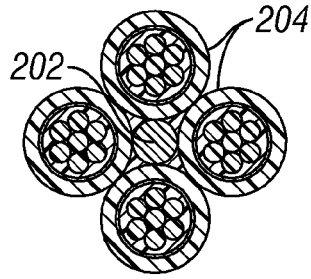
FIGS. 2*a*-2*c* are radial cross-sectional views, respectively, of steps for forming a cable assembly.
Figure 2A:
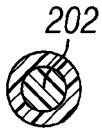
Figure 2C:
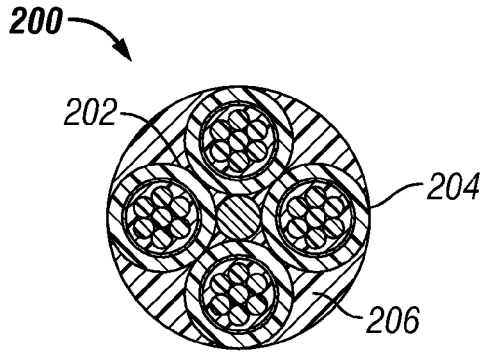

Referring now to FIG. 2*a*-2*c*, there is shown a method for manufacturing a cable assembly or core 200. The cable assembly 200 includes a soft elastomer-coated filler yarn or rod 202 that is preferably extruded as shown in FIG. 2*a*. At least one and preferably a plurality of cables or conductors 204 such as, but not limited to, the cable 100 shown in FIG. 1 are cabled helically around the rod 202 as shown in FIG. 2*b*. As the conductors 204 compress against the rod 202, the elastomeric material of the rod 202 deforms to fill any interstitial voids between the rod 202 and the conductors 204. An additional filler layer of an elastomeric material 206 is extruded over the rod 202 and the conductors 204 to complete the cable assembly 200, as shown in FIG. 2*c*.

Figure 3A:
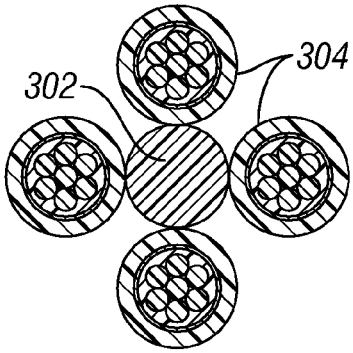
FIGS. 3*a*-3*f* are radial cross-sectional views, respectively, of alternate steps for forming a cable assembly.
Figure 3B:
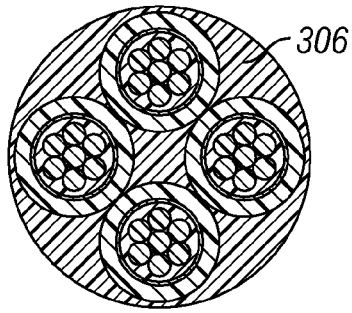
Figure 3C:
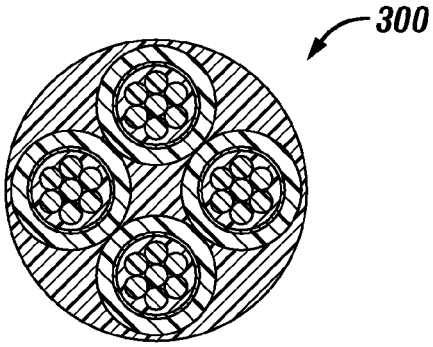
Figure 3D:
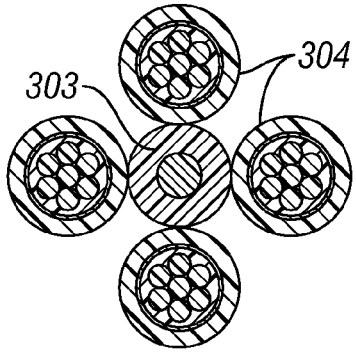
Figure 3E:
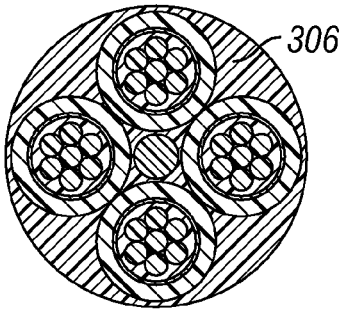
Figure 3F:
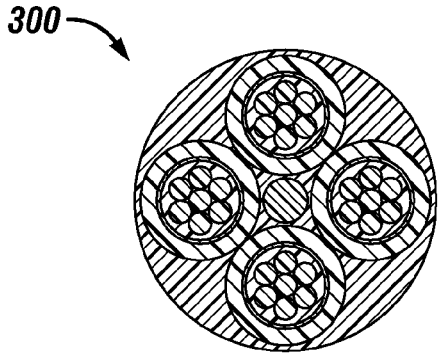

Referring now to FIG. 3*a*-3*e*, there is shown a method for manufacturing a cable assembly or core 300. The cable assembly 300 includes a solid polymer rod 302 (FIG. 3*a*) or hard TPE coated rod or yarn 303 (FIG. 3*d*) is provided as shown in FIG. 3*a* and FIG. 3*d*. The rod or yarn 302 or 303 is then heated to soften the polymer. At least one and preferably a plurality of cables or conductors 304 such as, but not limited to, the cable 100 shown in FIG. 1 are cabled helically around the rod 302 as shown in FIGS. 3*b* and 3*e*. As the conductors 304 compress against the rod 302, the elastomer of the rod 302 deforms to fill any interstitial voids between the rod 302 and the conductors 304. An additional filler layer of preferably soft elastomeric material 306 such as, but not limited to a TPE or TPV material, is extruded over the rod 302 and the conductors 304 to fill any outer interstitial voids and complete the cable assembly 300, as shown in FIGS. 3*c* and 3*f*. The cable assembly 200 or 300 is advantageously completely filled and requires no liquid rubber fillers. The elastomeric material 206 or 306 may be a TPE or TPV material such as, but not limited to, Santoprene™, Engage™, or Infuse™. To further minimize the potential for water flow along the conductors 204 or 304, the insulated conductors 204 or 304 and extruded elastomeric void filler 206 or 306 may be chemically bonded and/or physically compressed together during cabling or in the extruder.

Those skilled in the art will appreciate that the cable assemblies 200 or 300 may be formed from any number of cables and any combination of cables or conductors including, but not limited to, the cable 100. The cable assemblies 200 or 300 may be assembled utilizing three cables or conductors 100 to form a triad cable assembly 200 or 300. The cable assemblies 200 or 300 may be assembled utilizing four cables or conductors 100 to form a quad cable assembly 200 or 300. The cable assemblies 200 or 300 may be assembled utilizing seven cables or conductors 100 to form a hepta cable assembly 200 or 300.

Figure 4A:
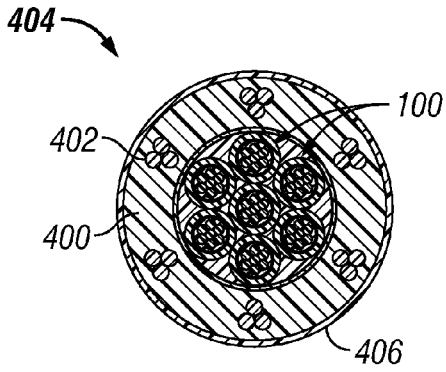
FIGS. 4*a*-4*c* are radial cross-sectional views, respectively, of embodiments of a cable assembly.
Figure 4B:
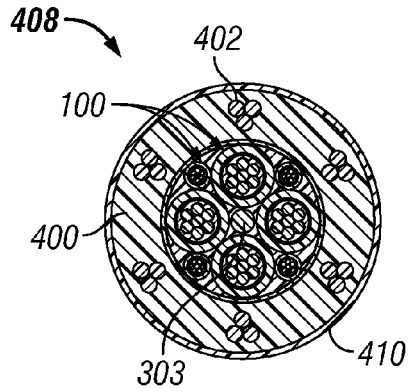
Figure 4C:
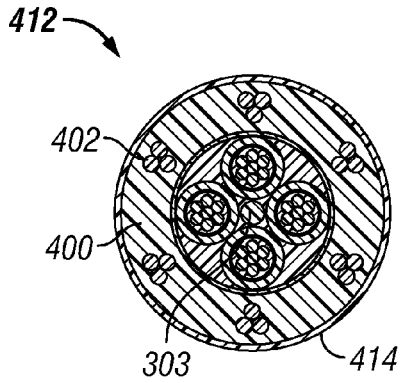

Referring now to FIG. 4*a*-4*c*, the cable assemblies, such as the cable assemblies 200 or 300 shown in FIGS. 2 and 3 may then be encased in an outer layer 400 formed from a polymeric material. The outer layer 400 may include a plurality of strength members 402 embedded therein. The strength members 402 may be formed from any suitable material including, but not limited to, steel wire, high carbon steel, Kevlar, Vectran yarn or the like. The strength members 402 may be oriented at a zero lay angle with respect to the cable core or cable assemblies 200 or 300 or the strength members 402 may be cabled helically about the cable core or cable assemblies 200 or 300. The strength members 402, when constructed from Kevlar or Vectran yarn, may be formed from a single yarn or from a plurality of yarns twisted together to form the strength member 402.

As shown in FIG. 4*a*, a cable assembly 408 includes seven cables or conductors 100 arranged in a hepta configuration and enclosed by the outer layer 400 and an outer shell 410 and including strength members 402 embedded in the outer layer 400.

As shown in FIG. 4*b*, a cable assembly 408 includes four cables or conductors 100 arranged in a quad configuration about a hard TPE coated rod or yarn 303 and enclosed by the outer layer 400 and an outer shell 410 and including strength members 402 embedded therein. The assembly 418 includes four smaller diameter cables or conductors 100 arranged in the interstices of the larger diameter cables or conductors 100.

As shown in FIG. 4*c*, a cable assembly 412 includes four cables or conductors 100 arranged in a quad configuration about a hard TPE coated rod or yarn 303 and enclosed by the outer layer 400 and an outer shell 414 and including strength members 402 embedded in the outer layer 400.

The outer layer 400 may be a soft matrix such as TPE or TPV and the outer shells 406, 410, and 412 may be formed from nylon or any suitable material to provide a tough jacket to prevent damage from field abuse and to provide rigidity to the cable assemblies 404, 408, or 412.

Figure 5A:
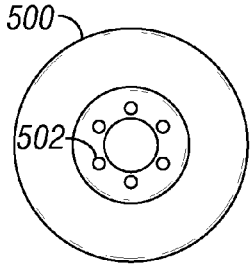
FIGS. 5*a* and 5*b* are an end view and plan view, respectively, of an extruder for forming a cable.
Figure 5B:
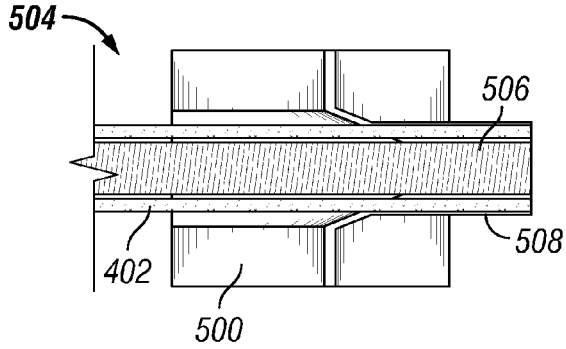

Referring now to FIG. 5*a*, there is shown an end view of an extruder 500 that comprises a plurality of apertures 502 for threading strength members, such as the strength members 402, therethrough to allow for placing the strength members 402 at a zero lay angle with respect to the cable core or cable assembly 200 or 300. FIG. 5*b* shows a side cross-sectional view of the extruder 500 with a cable 504 passing therethrough and including an inner layer 506 and an outer layer or jacket 508 being extruded over the strength members 402 and inner layer 506.

Figure 6A:
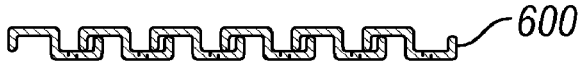
FIGS. 6*a* and 6*c* are axial and radial cross-sectional views, respectively, of a shield layer and cable including a shield layer of an embodiment of a cable
Figure 6B:
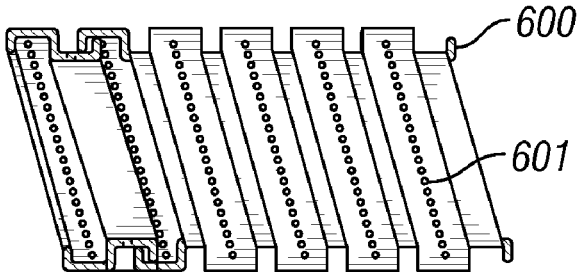
FIG. 6*b* is a side view of a shield layer.
Figure 6C:
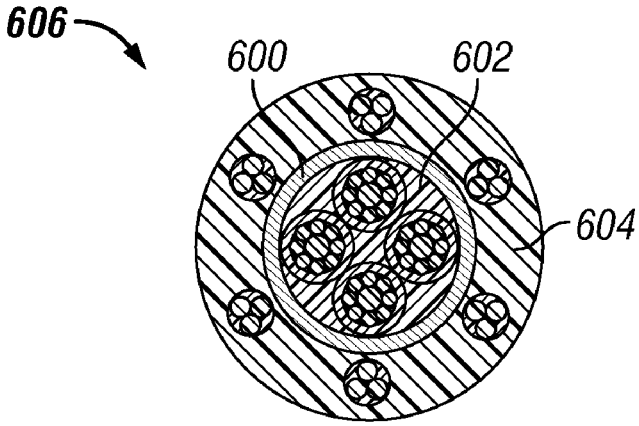
Figure 7A:
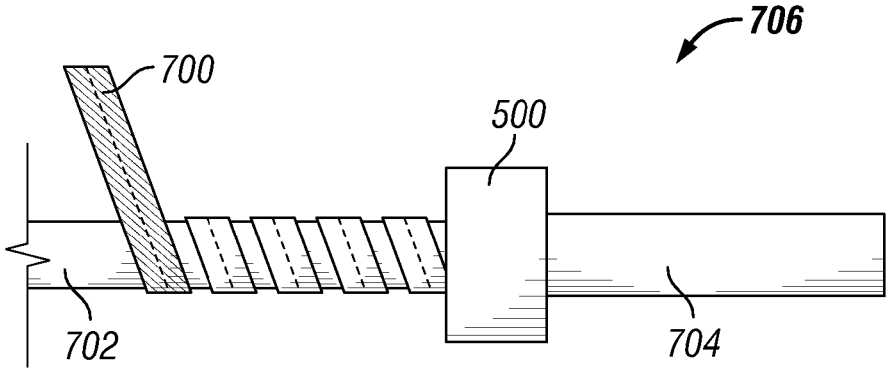
FIG. 7*a* is a side view and FIG. 7*b* is a radial cross-sectional view of an embodiment of a shield layer and cable including a shield layer.
Figure 7B:
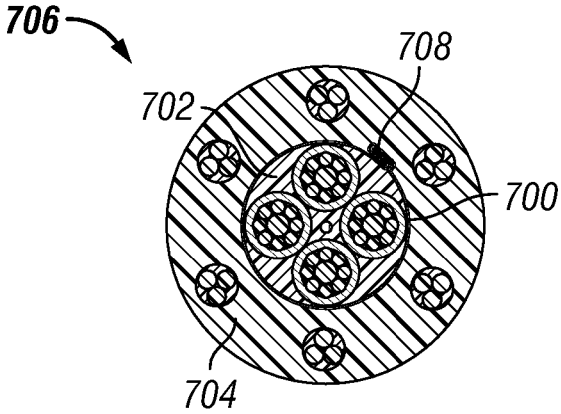
Figure 8:
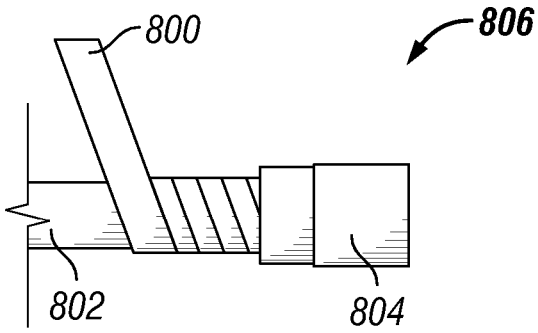
FIG. 8 is a side view of an embodiment of a cable having a shield layer.

Referring now to FIGS. 6*a*-8, the cable, such as the cable 100 include a shield or armor layer between the inner layer and outer layer of the cable 100. As shown in FIG. 6*a*-6*c*, the shield layer may comprise an interlocking metallic tape 600 disposed between an inner layer 602 and an outer layer or jacket 604 of a cable assembly 606. The tape 600 may include holes 601 extending therethrough to allow the outer jacket 604 to bond with the inner layer 602. As shown in FIGS. 7*a*-7*b*, the shield layer may comprise an interlocking metallic tape 700 disposed between an inner layer 702 and an outer layer or jacket 704 of a cable assembly 706. The metallic tape 700 may be folded over to form a locked edge 708, as shown in FIG. 7*b*. As shown in FIG. 8, the shield layer may comprise an overlapping or cigarette-wrapped metallic tape 800 disposed between an inner layer 802 and an outer layer or jacket 804 of a cable assembly 806. Placement of the shield layer 600, 700, or 800 between the core 602, 702, or 802 and the jacket 604, 704, or 804 may be preferable because its smaller diameter will requires less material for the shield layer 600, 700, or 800, resulting in a lower weight cable than if the shield layer 600, 700, or 800 is placed over the outer jacket 604, 704, or 804.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. An electrical cable, comprising:

a cable core comprising an electrical conductor;

a polymeric inner layer enclosing the cable core;

an outer layer enclosing the cable core and the polymeric inner layer, the outer layer operable to maintain integrity of the electrical cable within a predetermined temperature range; and a shield layer disposed between the polymeric inner layer and the outer layer, the shield layer comprising one selected from an interlocking metallic tape and a metallic mesh tape.

2. The electrical cable according to claim 1, wherein the predetermined temperature range is from about −60° Celsius to about 80° Celsius.

3. The electrical cable according to claim 1, wherein the outer layer comprises one of polyamide, thermoplastic polyurethane, thermoplastic vulcanizate, a hard grade thermoplastic elastomer, ethylene chlorotrifluoroethlyene, ethylene-tetrafluoroethylene copolymer, and combinations thereof.

4. The electrical cable according to claim 1, wherein the polymeric inner layer comprises one of polyolefin, fluoropolymer, thermoplastic elastomer, thermoplastic vulcanizate and combinations thereof.

5. The electrical cable according to claim 1, wherein the shield layer comprises holes formed through the one selected from the interlocking metallic tape and the metallic mesh tape.

6. An electrical cable assembly, comprising:

a plurality of electrical cables arranged about a filler rod to form a cable assembly core; and a filler layer of elastomeric material enclosing the cable assembly core, wherein the each of the plurality of electrical cables comprises:

a conductor core comprising at least one electrical conductor;

a polymeric inner layer enclosing the conductor core;

a polymeric outer layer enclosing the polymeric inner layer, the polymeric outer layer operable to maintain integrity of the electrical cable within a predetermined temperature range; and a shield layer disposed between the polymeric inner layer and the polymeric outer layer, the shield layer comprising one selected from an interlocking metallic tape and a metallic mesh tape.

7. The electrical cable assembly according to claim 6, wherein the at least one electrical conductor comprises a plurality of conductors arranged to form one selected from the group of a triad configuration, a quad configuration, and a hepta configuration.

8. The electrical cable assembly according to claim 6, further comprising a jacket layer enclosing the filler layer and the cable assembly core.

9. The electrical cable assembly according to claim 8, further comprising a plurality of strength members embedded in the jacket layer.

10. The electrical cable assembly according to claim 9, wherein at least one of the strength members is formed from Kevlar material.

11. The electrical cable assembly according to claim 10, wherein the at least one Kevlar strength member is oriented at a zero lay angle with respect to the cable assembly core.

12. The electrical cable assembly according to claim 6, further comprising a metallic tape wrapped around the filler layer.

13. The cable assembly according to claim 12, wherein metallic tape comprises an interlocking metallic tape.

14. The electrical cable assembly according to claim 6 wherein the filler rod is formed from one of a soft polymeric material, a hard TPE coated rod, and a hard TPE coated rod yarn.

15. A method for forming a cable, comprising:

providing at least one filler rod;

cabling a plurality of conductors about a filler rod to form a cable core, the filler rod filling internal interstices between the conductors, wherein each of the conductors comprise a conductor core comprising at least one electrical conductor, a polymeric inner layer enclosing the conductor core, an interlocking metallic tape wrapped around the polymeric inner layer, and a polymeric outer layer enclosing the conductor core, the polymeric inner layer, and the interlocking metallic tape, wherein the outer layer operable to maintain integrity of the conductor within a predetermined temperature range; and enclosing the cable core with a filler layer of elastomeric material that fills external interstices between the conductors to form the cable.

16. The method according to claim 15, further comprising enclosing the cable core and the filler layer in a jacket layer.

17. The method according to claim 16 further comprising disposing at least one strength member in the jacket layer.

18. The method according to claim 15 further comprising heating the filler rod to assist in cabling the conductors about the filler rod.

19. The method according to claim 15 wherein the filler rod and the filler layer are extruded.

* * * * *

UNITED STATES PATENT AND TRADEMARK OFFICE

CERTIFICATE OF CORRECTION

PATENT NO. : 7,915,532 B2
APPLICATION NO. : 12/135015
DATED : March 29, 2011
INVENTOR(S) : Joseph Varkey et al.

It is certified that error appears in the above-identified patent and that said Letters Patent is hereby corrected as shown below:

On the face of the patent document, Item 75, the second inventor name, "Byong Un Kim" should read --Byong Jun Kim--.

Signed and Sealed this
Tenth Day of July, 2012

David J. Kappos

David J. Kappos
*Director of the United States Patent and Trademark Office*